US005131558A

United States Patent [19]

Hiromori

[11] Patent Number: 5,131,558

[45] Date of Patent: Jul. 21, 1992

[54] RECEPTACLE FOR RECEIVING A SMALL ARTICLE

[75] Inventor: Junji Hiromori, Tokyo, Japan

[73] Assignee: Hiromori Inc., Tokyo, Japan

[21] Appl. No.: 602,216

[22] Filed: Oct. 22, 1990

[30] Foreign Application Priority Data

Oct. 25, 1989 [JP] Japan ..... 1-124693

[51] Int. Cl.[5] ..... B65D 45/16

[52] U.S. Cl. ..... 220/326; 220/338; 220/4.22

[58] Field of Search ..... 220/324, 326, 337, 338, 220/4.22, 4.23, 331

[56] References Cited

U.S. PATENT DOCUMENTS

| | | | |
|---|---|---|---|
| 2,633,265 | 3/1953 | Zipper | 220/324 |
| 4,540,090 | 9/1985 | Gelardi et al. | 206/387 |
| 4,693,392 | 9/1987 | Contreras, Sr. | 220/343 |
| 4,746,013 | 5/1988 | Suzuki et al. | 206/309 |
| 4,774,973 | 10/1988 | Gueret | 220/326 |
| 4,799,604 | 1/1989 | Okojima et al. | 220/260 |
| 4,901,882 | 2/1990 | Goncalves | 220/324 |
| 4,913,287 | 4/1990 | Kagano | 206/387 |
| 4,917,131 | 4/1990 | Contreras, Sr. | 132/301 |

FOREIGN PATENT DOCUMENTS

| | | | |
|---|---|---|---|
| 2147038 | 2/1980 | Fed. Rep. of Germany | 220/324 |
| 31713 | 3/1961 | Finland | 220/326 |
| 936618 | 7/1948 | France | 220/326 |
| 2102896 | 7/1972 | France | 220/324 |

*Primary Examiner*—Stephen Marcus
*Assistant Examiner*—Stephen Cronin
*Attorney, Agent, or Firm*—Dilworth & Barrese

[57] ABSTRACT

The present invention discloses a receptacle for receiving a small article. The receptacle for receiving a small article comprises a receptacle body, a cover and a closing operation plate made of plastics each which is independently and integrally formed by injection molding so as to constitute the receptacle by assembling these constitutional members.

According to the receptacle for receiving a small article of the present invention, there is no danger of loosening the connecting portion of the receptacle body and the cover or no danger of loosening a locking condition of the cover. Further unlocking action may easily be carried out.

6 Claims, 4 Drawing Sheets

RECEPTACLE FOR RECEIVING A SMALL ARTICLE

BACKGROUND OF THE INVENTION

The present invention relates to a receptacle for receiving a small article.

As a conventional plastic receptacle for receiving a small article, a receptacle comprising a receptacle body integrally molded by injection molding, a cover fixed to said receptacle body by means of a hinge, said cover being automatically locked by latching a hook portion of said cover with an engaging projection of said receptacle body when said cover is closed and a lock and lock releasing means of the cover, e.g. a means for pushing the hook down from the outside of said hook for separating from the engaging projection when said cover is caused to open by releasing a locking state, was publicly known.

However, according to the lock of the cover or the lock releasing means of the aforementioned conventional receptacle, there was such inconvenience that in when the hook portion of the cover is latched to the engaging projection of the receptacle body when the cover is closed, tension stress to the hinge connecting the cover is actuated to stress to the hinge portion, so that the connecting portion of the receptacle body and the cover is loosened and thus a locking state of the cover is also weakened.

SUMMARY OF THE INVENTION

With the above in mind, it is an object of the present invention to provide a receptacle for receiving a small article easily capable of locking or releasing the cover of said receptacle without causing any looseness at the connecting portion of the receptacle body and the cover and further without causing any weakness in the locking state of said cover to eliminate the aforementioned conventional inconvenience.

The aforementioned object can be attained by the receptacle for receiving a small article comprising a receptacle body, a cover and a closing operation plate made of plastics each being independently and integrally formed by injection molding so as to constitute a receptacle for receiving a small article by assembling said constitutional members, the receptacle body and the cover being connected to each other by pushing axial projections into axial holes, the closing operation plate being incorporated within a sliding groove mounted at the upper surface of the cover, said cover being closed by engaging a hook with a latching plate of the cover and said cover being opened by pushing the hook by means of an operative projection of the closing operation plate to separate from said latching plate. When the cover(3) is closed onto the receptacle body(2), the hook(8) is guided by means of a hook guide hole(16) so as to push an operative projection(32) outwards from the inside of a fitting-in hole(15). As a result, said hook engages with the latching plate(17). At that time, since said hook(8) is in a somewhat shifted position from the center of the hook guide hole(16), a taper face(10) of said hook is slidably guided into the hook guide hole, while keeping a somewhat bending state due to pressing down by a reverse taper face (26) and the hook(8) automatically engages with the latching plate(17) due to the elasticity thereof in passing through the hook guide hole(16); and at the same time the taper face(10) of the hook abuts the reverse taper face(35) of operative projection (32) so as to force said operative projection outwardly of the fitting-in hole(15). The closing operation plate(4) is also moved proportional to the length of the movement of the operative projection(32) caused by the outwards pushing action of the operative projection (32), but the closing operation plate(4) is controlled to a prescribed length of the movement due to the engagement of a projection(33) with a stopper(13). Therefore, the stopper pushes out the operative projection(32) somewhat outwardly of the fitting-in hole(15) against the aforementioned movement and tension generates in the closing operation plate(4) in proportion to the prevention of the movement. In the above state, the reverse taper face(35) of the operative projection(32) abuts the taper face (10) of the hook (8).

When a touch plate(30) is pushed with the finger, the operative projection(32) presses to press into the hook(8) and the hook(8) is released out of the latching plate(17) to open the cover(3) with one touch action. Since tension is applied to the closing operation plate(4) in some degree due to pushing out of the hook(8), the cover(3) may be released out of its locking state immediately by means of pushing down the touch plate(30) a little.

BRIEF DESCRIPTION OF THE DRAWINGS

In the Figures.

DESCRIPTION OF THE PREFERRED EMBODIMENTS

Hereinafter, embodiments according to the present invention will be described in detail with reference to the drawings.

Figure 1:
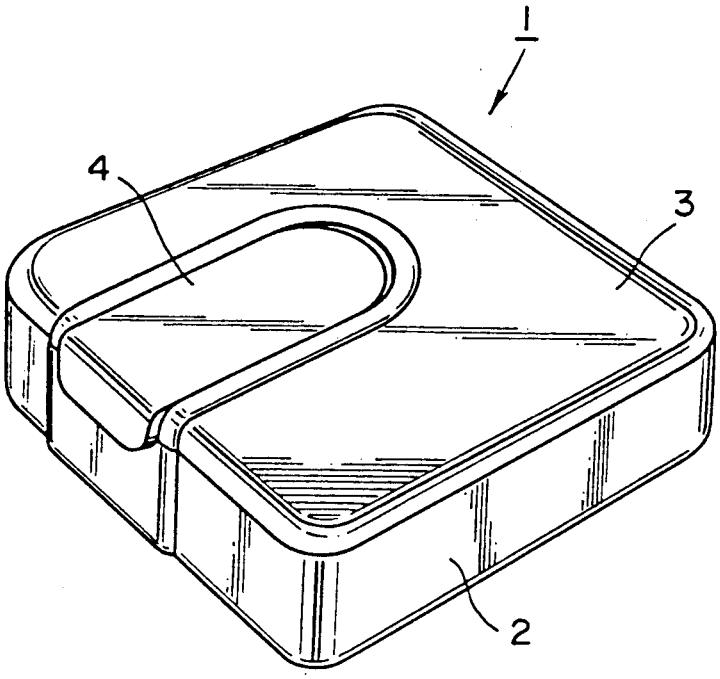
FIG. 1 is a perspective view of a receptacle for receiving a small article according to the present invention.
Figure 2:
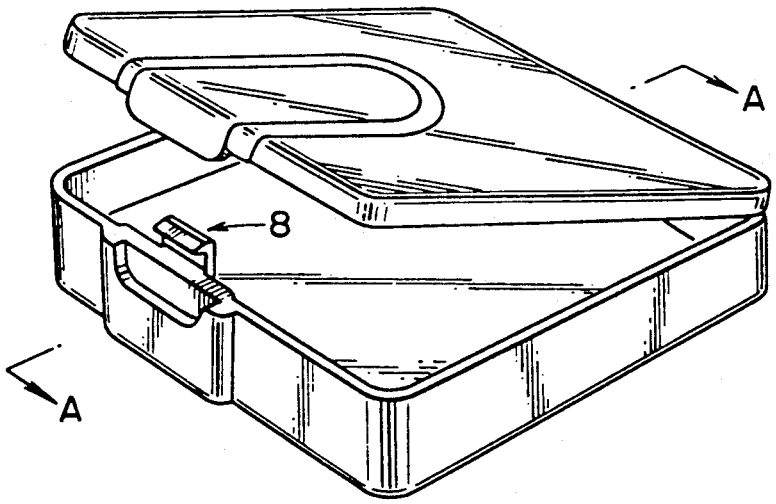
FIG. 2 is a perspective view of said receptacle, wherein a cover of said receptacle is open.

FIG. 1 is a perspective view of a receptacle (1) for receiving a small article(1) according to the present invention. The receptacle(1) consists of a receptacle body(2), a cover(3) and a closing plate(4) made of plastics each molded by injection molding independently and integrally and then said each constitutional member is assembled so as to constitute the receptacle.

Figure 3:
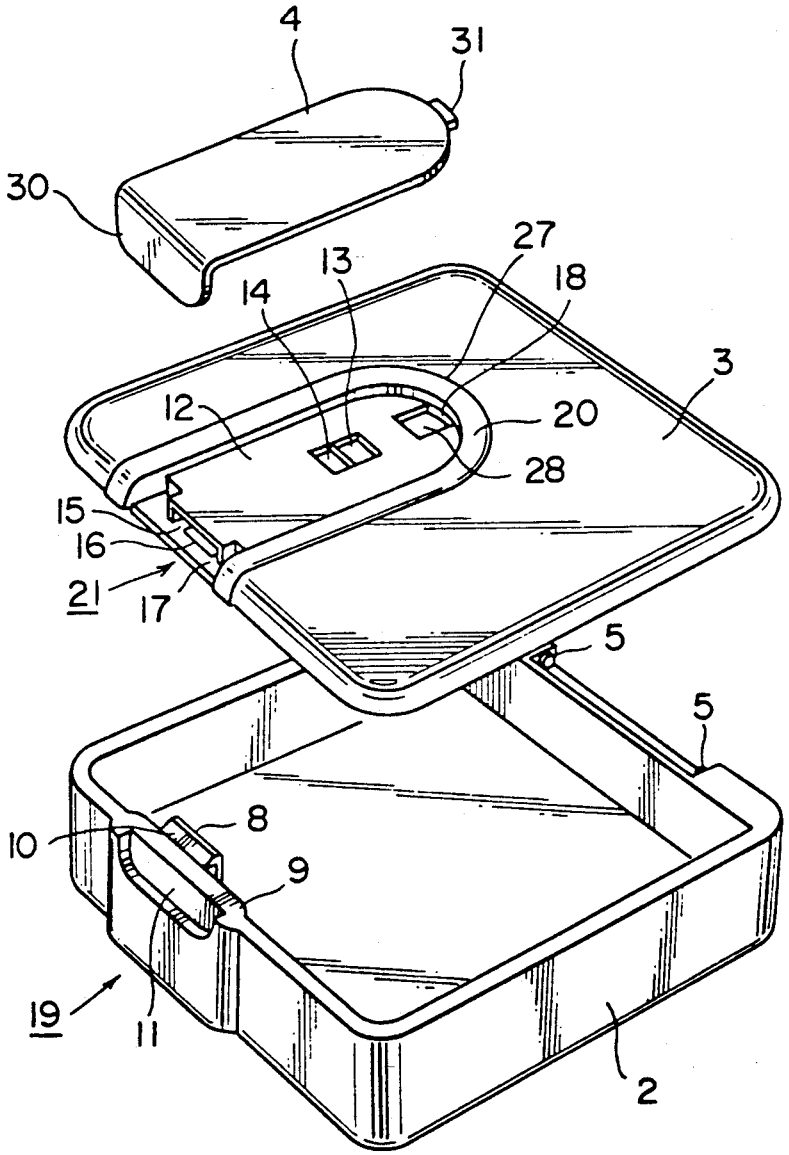
FIG. 3 and FIG. 4 are analytical views of the receptacle as shown in FIG. 1.
Figure 4:
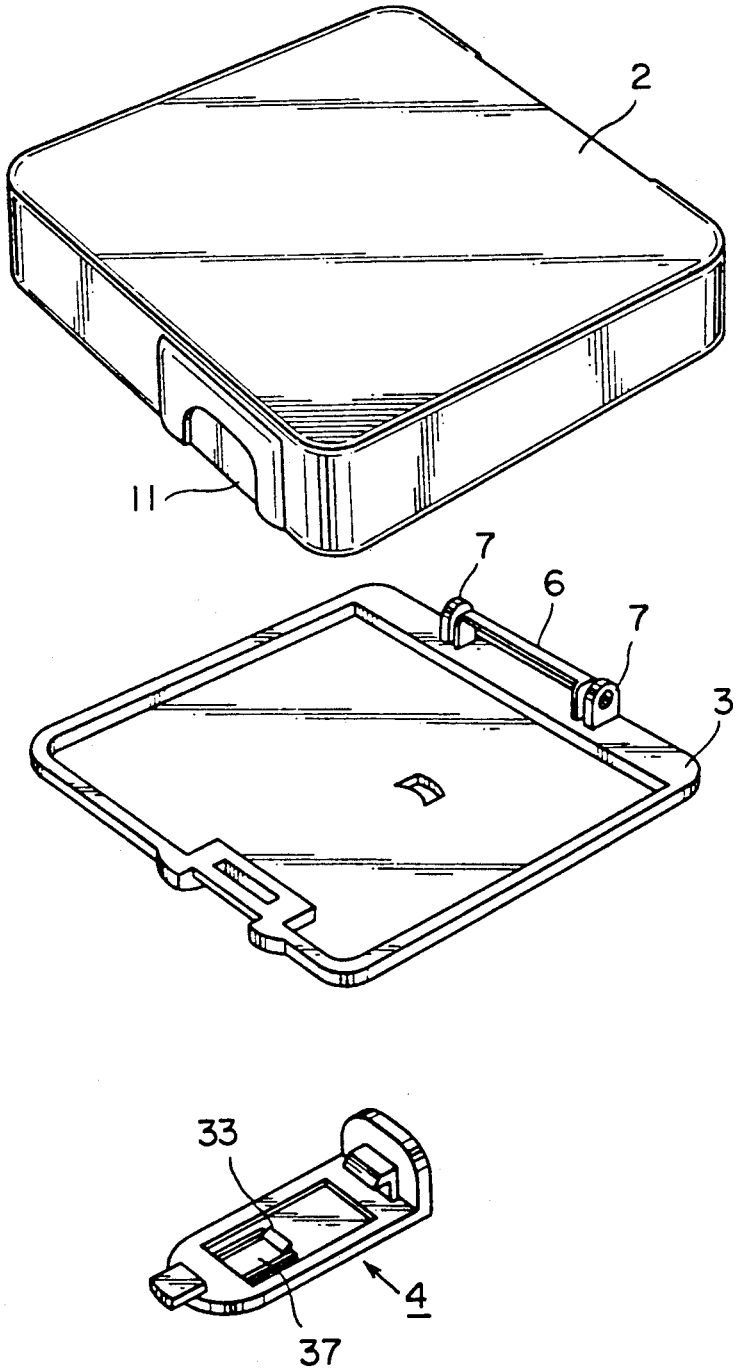

As illustrated in FIG. 3 and FIG. 4, the receptacle body(2) and the cover(3) are connected to each other pivotally free by fitting two axial projections(5)(5) mounted at the peripheral edge of the receptacle body(2) into axial holes(7)(7) mounted at both ends of a supporting frame(6) of said cover.

The receptacle body(2) has the shape of a square as shown in the Figures, but it need not be limited thereto. The receptacle body(2) is provided with a hook(8) at a peripheral edge opposing to the edge to which the cover(3) is connected. Said hook (8) is mounted in a raised state from an inner peripheral surface of the receptacle body and extends upwards from the upper surface(9) of the peripheral edge and further provides with a taper face(10) facing outward from the receptacle body (2).

Reference numeral (11) denotes a fitting-in groove of a touch plate(30). The cover(3) consisting of a sliding groove(12) and a stopper(13) mounted within a stopper recess(14), a fitting-in hole(15), a hook latching plate(17) and an insertion hole(18).

The sliding groove(12) is mounted at a position corresponding to a fitting position(19) of the hook(8) by forming a raised edge(20) at an upper surface of said cover. Further, said groove(12) is open to one end edge of the cover(3) and extends in the shape of U substantially towards the inside of said cover. Of course, the shape of said sliding groove may be formed in the shape of a rectangle.

The stopper recess(14) is positioned at an upper surface of the cover(3) in the shape of a rectangular groove is further provided with the stopper(13) partitioning said groove laterally said stopper(13) somewhat projects out of the upper surface(50) of the cover(3).

Figure 5:
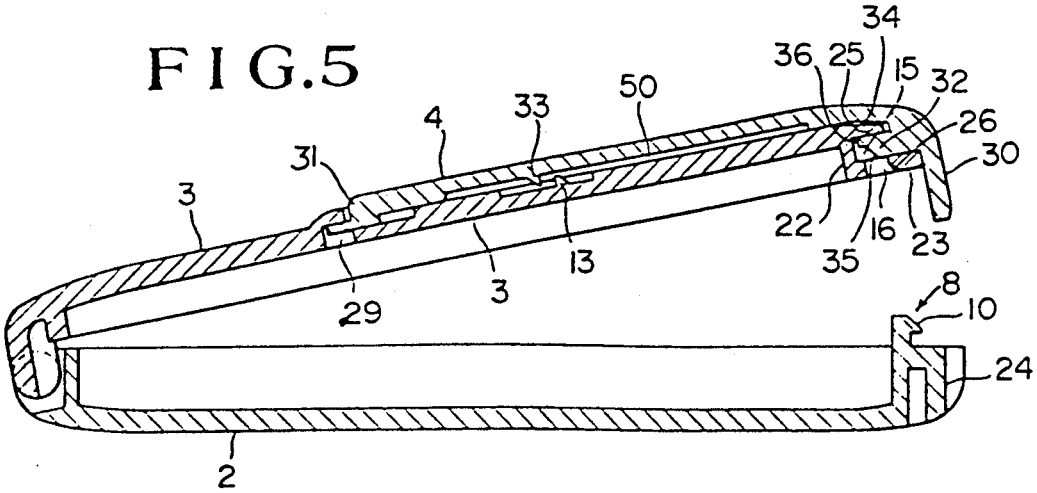
FIG. 5 is a sectional view taken along line A—A in FIG. 2.
Figure 6:
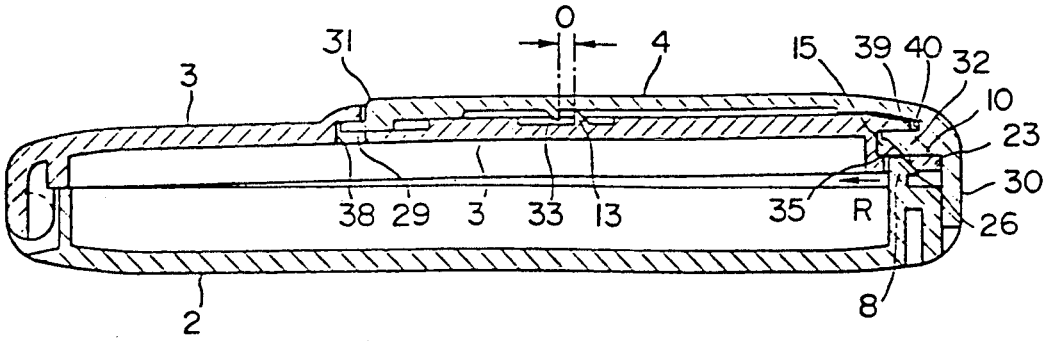
FIG. 6 and FIG. 7 are sectional views explaining operation of the receptacle of the present invention.

The fitting-in hole (15) is positioned at an opening side of the sliding groove(12). As illustrated in FIG. 5 and FIG. 6, said fitting-in hole(15) is formed to have a rectangular opening portion by means of a supporting frame(22) extending in the shape of an "L" from a lower surface of the cover(3) and , when the cover is closed onto the receptacle body(2), a lower projection(23) forming the fitting-in hole(15) has the same length as an external peripheral surface(24) of the receptacle body provided with the hook(8) and further an upper projection(25) is shifted somewhat inwardly from the lower projection(23).

The hook guide hole(16) is mounted at said lower projection (23) and slidably guides the hook(8). Said hole(16) is a rectangular through hole in conformance with to the shape of the hook(8) and is further provided with a reverse taper face(26) at one side of the inner surface of the opening. When the cover(3) is closed, the hook guide hole(16) is arranged to have a position somewhat shifted from a fitting position of the hook(8) as illustrated in the Figure.

A hook latching plate(17) is arranged at an upper end opening edge of the hook guide hole(16) which is open at the upper surface of the lower projection (23) and the hook(8) engages with said opening edge.

An insertion inlet(18) is positioned within an insertion inlet recess (28) mounted on the cover(3) in a manner adjacent the raised edge(20) at the end(27) of the sliding groove(12) and opens to the lower surface of said raised edge(20) and further communicates with a hole(29) perforated at the back of the cover(3) from the lower surface of said risen edge(20).

The closing operation plate(4) is formed substantially in the shape of a plate and is further incorporated in the sliding groove. Said plate(4) consists of a touch plate(30), a tongue piece(31), an operative projection(32), a fitting-in groove and a projection(33). Said touch plate(30) is formed by bending one end of the closing operation plate(4) and has the shape fitting into the fitting-in groove of the receptacle body. The tongue piece(31) is mounted with a step at the end face at the side opposing to the touch plate(30) of the closing operation plate(4).

The operative projection(32) is mounted projectively at the back of the touch plate(30) and further the fitting-in groove(34) fitting into the upper projection(25) of the cover is mounted between the back surface of the closing operation plate(4) and the operative projection(32). The operative projection has the width and thickness suitable for sliding within the fitting-in hole(15) of the cover(3) and is further provided with the reverse taper face(35) at the front edge portion thereof.

The projection(33) is mounted laterally within a rectangular recess(37) mounted at the back surface of the closing operation plate(4) as illustrated in FIG. 4.

In order to incorporate the closing operation plate(4) in the sliding groove(12) of the cover(3), firstly, the tongue piece(31) of the closing operation plate(4) is inserted into the hole(29) within the insertion recess(28) through the insertion inlet(18). ( The tongue piece(31) is freely movable within the hole(29) and thus may easily be inserted thereinto). Then, the upper projection (25) is forced to fit into the fitting-in groove(34) by utilizing the elasticity of the closing operation plate(4).

At that time, the projection(33) engages the stopper (13), so that the sliding action of the closing operation plate(4) is prevented, but by forcing to contact the reverse taper face(26) of the operative projection(32) with the end portion(45) of the upper projection(25), the operative projection (32) is fitted into the fitting-in hole after riding across the end portion(45) when pushed down by utilizing the elasticity of a material; and at the same time, the upper projection(25) is fitted into the fitting-in groove(34). As illustrated in FIG. 6, when the closing operation plate (4) is incorporated in the sliding groove(12) and further the operative projection(32) is fitted fully into the fitting-in hole(15), the tongue piece(31) has space which does not abut the inner surface(38) of the hole(29) and further the stopper (13) of the cover(3) and the projection(33) of the closing plate(4) are separated by space 0. Thus, the closing operation plate(4) is incorporated in the sliding groove(12) in a manner having certain space between the end surface(39) of the upper projection(25) and the inner surface(40) of the fitting-in groove (34).

Figure 7:
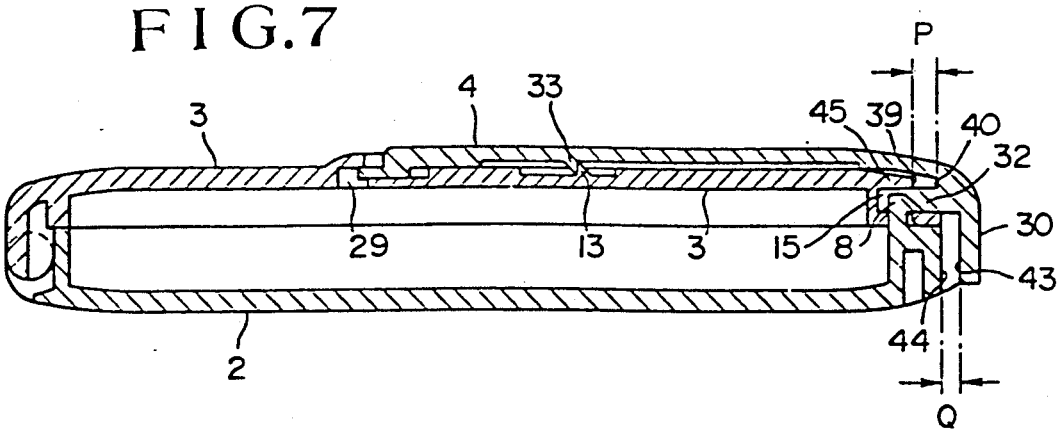

As illustrated in FIG. 7, when the closing operation plate (4) is slidably moved within the sliding groove(12) until the projection(33) is latched by the stopper(13), space P is generated between the end face(39) of the upper end projection (25) of the cover(3) and the inner surface(42) of the fitting-in groove(34).

However, the front end portion (45) of the upper end projection(25) is still supported within the fitting-in groove(34) and the tongue piece(31) is thus supported without separating from the hole(29). Space 0 between the stopper(13) and the projection(33) as shown in FIG. 6 corresponds to the space Q between the inner surface(43) of the touch plate(30) and the external peripheral surface(44) of the receptacle body(2). The closing operation plate(4) is incorporated in the cover(3) in a manner that said plate(4) may slide within the sliding groove(12) on the aforementioned condition and further the space 0 between the stopper (13) and the projection (33) and the space Q between the inner surface (43) of the touch plate(30) and the external peripheral surface(24) of the receptacle body(2) are prescribed to have the same length. The operative projection(32) slides within the fitting-in hole(15) and the tongue piece(31) moves within the hole(29) on the condition that the closing operation plate slides only along the aforementioned length. When the closing operation plate(4) is incorporated in the sliding groove(11), the tongue piece(31) is at first inserted into the insertion inlet(18) and then the upper end projecting edge(25) is fitted into the fitting-in groove(34); at the same time the operative projection(32) is fitted into the fitting-in hole(15). It may further be possible that the upper end projection edge(25) is fitted into the fitting-in groove(34) at first and at the same time the operative projection(32) is fitted into the fitting-in hole(15). Then, the tongue piece(31) is fitted into the insertion inlet(18) so as to incorporate the closing operation plate(4) in the sliding groove(12) of the cover(3) by utilizing the elasticity of the closing operation plate(4).

In order to close the cover(3), when the cover is pushed down with the finger onto the receptacle body(2), the hook(8) of said receptacle body is latched with the latching plate of the cover(3) so as to close the cover(3).

When the cover(3) is pushed down onto the receptacle body (2), the taper face(10) of the hook(8) abuts the reverse taper face(26) of the hook guide hole(16). The hook guide hole (16) is mounted at somewhat shifted position from the position of said hook; and accordingly the taper face(10) of the hook(8) abuts at first the reverse taper face(26) of the guide hole(16) and the hook(8) slides somewhat bendingly in the direction of an arrow R in FIG. 6 while slidably guided along the hook guide hole(16). When the hook(8) is further slidably guided into the hook guide hole(16), the reverse taper face(35) of the operative projection(32) fitted into the fitting hole(16) of the cover(3) is moved outward the fitting-in hole(15) to have been pushed down by means of the taper face(10) of the hook(8). When the taper face (10) of the hook(8) passes through the hook guide hole(16) after sliding along the reverse taper face(26) of the hook guide hole(16), the hook(8) engages vigorously with the latching plate(17) due to the elasticity thereof so as to close the cover(3).

At that time, the taper face(10) of the hook(8) abuts the reverse taper face(35) of the operative projection(32) due to the engagement of the hook with the latching plate(17) and thus the hook(8) acts to push the operative projection(32) toward the outside of the fitting-in hole(15). That is to say, the space 0 between the stopper(13) of the cover(3) and the projection(33) of the closing operation plate(4) is prescribed to be somewhat shorter than the moving length of the operative projection(32) toward the outside of the fitting-in hole(15). Further, the operative projection(32) is still pushed toward the outside of the fitting-in hole(15) by means of the hook(8) even when the closing operation plate(4) is prevented from sliding within the sliding groove (12). The pushing force applied to the operative projection(32) by means of the hook(8) still acts as a tensile strength for drawing the closing operation plate(4) prevented from moving by means of the stopper(13), to generate tensile stress in the closing operation plate(4).

Said tensile stress is absorbed into the elasticity of the material of the closing operation plate(4); and as a result no stress is applied to the connecting portion of the receptacle body(2) and the cover(3).

The cover(3) is automatically opened by merely pushing the touch plate(30) down with the finger.

When the touch plate(30) is pushed down with the finger, the closing operation plate(4) slides along the sliding groove (12) and further the projection(33) moves in the direction where it separates from the engagement with the stopper(13). By fitting the touch plate(30) thereinto, the reverse taper face(35) of the operative projection(32) acts to push the taper face(10) of the hook(8) inwardly in the fitting-in hole(15). By pushing the hook(8) down by means of the operative projection (32), the hook(8) separates from the latching plate(17). When further pushed down, the taper face(10) of the hook(8) is caused to slide along the reverse taper face(35) of the operative projection(32) downwardly and then the hook(8) is guided within the hook guide hole(16); and at the same time further abuts the reverse taper face(26) of the hook guide hole(16) so as to slide downwardly.

Thus, the hook(8) also separates from the hook guide hole (16) so as to open the cover(3).

According to the receptacle for receiving a small article of the present invention, there is no fear of causing looseness at the connecting portion of the receptacle body and the cover or no fear of causing looseness of a locking state of the cover and furthermore a locking or lock releasing action can easily be carried out.

What is claimed is:

1. A receptacle for receiving a small article, comprising:

a receptacle body (2), a cover (3) rotatably coupled to said receptacle body (2), and a closing operation plate (4), said receptacle body (2), cover (3) and plate (4) being made of plastics and each being independently and integrally formed by injection molding to constitute a receptacle for receiving a small article, the closing operation plate (4) being incorporated within a sliding groove (12) mounted upon an upper surface of the cover (3), said cover being caused to close by engaging a hook (8) with a latching plate (17) of the cover (3), and said cover being caused to open by pushing the hook by means of an operative projection (32) of the closing operation plate so as to separate from said latching plate.

2. A receptacle for receiving a small article, comprising:

a receptacle body (2), a cover (3), and a closing operation plate (4), said receptacle body (2), cover (3) and plate (4) being made from plastics and each being independently and integrally formed by injection molding to constitute a receptacle for receiving a small article, the receptacle body (2) and the cover (3) being coupled to one another by pushing axial projections (5) (5) into axial holes (7) (7), the closing operation plate (4) being incorporated within a sliding groove (12) mounted upon an upper surface of the cover (3), said cover being caused to close by engaging a hook (8) with a latching plate (17) of the cover (3), and said cover being caused to open by pushing the hook by means of an operative projection (32) of the closing operation plate so as to separate from said latching plate, wherein said hook formed to rise out of an inner surface of the receptacle body (2) is provided with a taper face (10) facing toward the outside of the receptacle body, the cover (3) comprises a stopper (13), a stopper recess (14), a fitting-in hole (15), a hook guide hole (16), a hook latching plate (17) and an insertion inlet (18) respectively formed or positioned within said cover being caused to open by pushing the hook, said sliding groove (12), said sliding groove being formed by a raised edge (20) of the upper surface of the cover and being open to one end edge (21) of the cover, the stopper (13) being mounted within the stopper recess (14) of the cover, the fitting-hole (15) being formed to have a substantially rectangular opening by means of a supporting frame (22) mounted at an opening side of the sliding groove (12), the hook guide hole (16) for slidably guiding the hook (8) mounted at a lower projection edge (23) at a shifted position from a fitting position of the hook being formed in the shape of a substantially rectangular through hole to conform to the shape of the hook and further being provided with a reverse taper face (26) at one inner surface of the lower end opening of said hole, the hook latching plate (17) being disposed at the upper opening edge of the hook guide hole (16), the insertion inlet (18) being mounted within an insertion inlet recess (28) of the sliding groove (12) in a manner such that said insertion inlet may communicate with a hole (29) of a lower surface of the raised edge (20), the closing operation plate (4) comprising a touch plate (30), a tongue piece (31), an operative projection (32) and a projection (33) substantially formed in the shape of a plate being incorporated in the sliding groove (12), the touch plate (30) being formed by bending one end of said operative plate (4), the tongue piece (31) being mounted at an end surface opposite to the touch plate (30), the operative projection (32) being projectively mounted at the back of the touch plate (30), a fitting-in groove (34) of said closing operation plate being positioned between the back of the closing operation plate (4) and the operative projection (32) so as to fit an upper end projection (25) of the cover thereinto, the operative projection (32) having length and width suitable for sliding within the fitting-in hole (15) of the cover (3) and being provided with a reverse taper surface (35) at the front end thereof, the projection (33) being laterally mounted within a rectangular recess (37) mounted at the back of the closing operation plate (4), the tongue piece of said closing operation plate being inserted into the hole (29) through the insertion inlet (18) so as to fit the upper end projection (25) into the fitting-in groove (34), and the operative projection (32) being fitted into the fitting-in hole (15) of the cover (3) so as to be incorporated into the sliding groove of the cover.

3. The receptacle for receiving a small article according to claim 2, wherein said tongue piece (31) of said closing operation plate (4) is positioned without abutting the inner surface of the hole (29), the stopper (13) and the projection (33) separated by a space (0) being incorporated to provide space between an end face (39) of the upper end projection (25) and the inner surface (40) of the fitting-in groove (34) when the operative projection (32) of the closing operation plate (4) is fully fitted into the fitting-in hole (15) and the front end(45) of the upper end projection (25) being supported within the fitting-in groove (34), and further the tongue piece (31) being supported without separating from the hole (29) even when a space (P) is generated between the end face (39) of the upper end projection (25) of the cover (3) and the inner surface (40) of the fitting-in groove (34) in sliding the closing operation plate (4) until the projection (33) is latched by means of the stopper (13).

4. The receptacle for receiving a small article according to claim 3, wherein when the hook (8) engages the latching plate (17), the operative projection (32) of the closing operation plate (4) is pushed outward from the fitting-in hole (15) to move until prevented by means of the stopper (13) within the sliding groove (12), and the hook (8) pushes the closing operation plate (4) outwardly from the fitting-in hole (15) to some degree to close the cover (3) even when the movement of the closing operation plate (4) is prevented.

5. The receptacle of claim 1, wherein said closing operation plate (4) is substantially flat.

6. The receptacle of claim 1, wherein said cover (3) is rotatably mounted upon said receptacle body (2) by means of axial projections (5) (5) fitting into complementary axial holes (7) (7).

* * * * *